US007726084B2

(12) United States Patent
Sourlis

(10) Patent No.: US 7,726,084 B2
(45) **Date of Patent: *Jun. 1, 2010**

(54) DRAINAGE SYSTEMS FOR USE IN MASONRY BLOCK CONSTRUCTION

(76) Inventor: Tom Sourlis, 3646 Ridge Rd., Highland, IN (US) 46322

( * ) Notice: Subject to any disclaimer, the term of this patent is extended or adjusted under 35 U.S.C. 154(b) by 639 days.

This patent is subject to a terminal disclaimer.

(21) Appl. No.: 10/841,576

(22) Filed: May 10, 2004

(65) Prior Publication Data

US 2004/0231261 A1 Nov. 25, 2004

Related U.S. Application Data

(63) Continuation-in-part of application No. 10/393,689, filed on Mar. 21, 2003, now Pat. No. 7,216,460.

(51) Int. Cl.
*E04B 1/70* (2006.01)
*E04B 2/14* (2006.01)

(52) U.S. Cl. ..... 52/302.1; 52/169.5

(58) Field of Classification Search ..... 52/62, 52/169.5, 302.1, 302.3, 302.4, 302.6, 293.2
See application file for complete search history.

(56) References Cited

U.S. PATENT DOCUMENTS

| | | | | |
|---|---|---|---|---|
| 835,669 | A | 11/1906 | Eckley | |
| 1,746,816 | A | 2/1930 | Boes | |
| 1,927,881 | A | 9/1933 | Wetmore | |
| 2,061,633 | A | 11/1936 | Muller | |
| 2,140,407 | A * | 12/1938 | Schilling | 52/413 |
| 2,657,570 | A | 11/1953 | Moore | |
| 2,934,931 | A | 5/1960 | Johnson | |
| 3,241,272 | A | 3/1966 | Edwards | |
| 3,293,810 | A | 12/1966 | Cox | |
| 3,429,084 | A | 2/1969 | Brewer | |
| 3,668,829 | A | 6/1972 | Nelson | |
| 4,253,285 | A | 3/1981 | Enright | |
| 4,272,931 | A | 6/1981 | Stanizzo | |
| 4,375,143 | A | 3/1983 | Godlewski | |
| 4,612,742 | A | 9/1986 | Bevilacqua | |
| 4,700,512 | A * | 10/1987 | Laska | 52/58 |

(Continued)

OTHER PUBLICATIONS

Masonry Technology Incorporated, Weep Systems and Moisture Control Devices for Concrete Masonry Construction, 1999.*

*Primary Examiner*—Robert J Canfield
*Assistant Examiner*—Christine T Cajilig
(74) *Attorney, Agent, or Firm*—McDonnell Boehnen Hulbert & Berghoff LLP

(57) ABSTRACT

A drainage system comprises an elongate flashing member, to be received beneath a course of CMUs, in use. A layer of water permeable material is attached to an upper surface of the flashing member. The water permeable material includes a longitudinal portion extending longitudinally adjacent a rear edge of the flashing member and a plurality of transverse portions extending transversely from the longitudinal portion to a front edge of the flashing member. A plurality of blocks of water permeable material are provided, each being positioned above the layer of water permeable material and extending upwardly into cavities of CMUs, in use. The water permeable material of the layer and the blocks has a porosity sufficient to permit water to pass therethrough but substantially insufficient to permit mortar and debris to pass therethrough so that water in cavities of the CMUs drains through the transverse portions.

9 Claims, 9 Drawing Sheets

U.S. PATENT DOCUMENTS

| | | | | |
|---|---|---|---|---|
| 4,907,385 | A | 3/1990 | Biodrowski | |
| 4,910,931 | A | 3/1990 | Pardue, Jr. | |
| 5,115,614 | A | 5/1992 | McGrath | |
| 5,120,162 | A | 6/1992 | Parker | |
| 5,230,189 | A | 7/1993 | Sourlis | |
| 5,274,968 | A * | 1/1994 | Pardo | 52/97 |
| 5,343,661 | A * | 9/1994 | Sourlis | 52/169.5 |
| 5,596,857 | A | 1/1997 | Besche | |
| 5,870,864 | A | 2/1999 | Snyder et al. | |
| 5,937,594 | A | 8/1999 | Sourlis | |
| 5,946,870 | A | 9/1999 | Bifano et al. | |
| 6,000,186 | A | 12/1999 | Fielding et al. | |
| 6,023,892 | A * | 2/2000 | Sourlis | 52/169.5 |
| RE36,676 | E | 5/2000 | Sourlis | |
| 6,202,366 | B1 | 3/2001 | Snyder et al. | |
| 6,745,531 | B1 * | 6/2004 | Egan | 52/302.1 |
| 2005/0155309 | A1 * | 7/2005 | Argila | 52/596 |

* cited by examiner

DRAINAGE SYSTEMS FOR USE IN MASONRY BLOCK CONSTRUCTION

This is a continuation-in-part of Ser. No. 10/393,689, filed on Mar. 21, 2003 now U.S. Pat. No. 7,216,460.

FIELD OF INVENTION

This invention relates to concrete masonry unit wall construction and, more particularly, to drainage systems therefor.

BACKGROUND OF THE INVENTION

Single wythe masonry walls are constructed using concrete masonry units (CMUs). CMUs are sometimes referred to as cinder blocks. A CMU consists of a hollow rectangular building block having one or more vertical cavities. In single wythe masonry wall construction a foundation is formed, typically of concrete. The wall is formed by laying the CMUs in alternating fashion in multiple courses depending on the height of the wall. Owing to the construction, the vertical cavities of CMUs are aligned to provide a continuous channel from the top of the wall down to the foundation. Mortar is used in joints to join the CMUs.

Cracks in the CMUs can allow water to enter the cavities. Moisture can also condense in the cavities under changing temperatures. Either way, water may collect in the cavities in the CMUs.

The presence of moisture in the cavities is undesirable for a number of reasons. First, the trapped moisture can degrade the structure. Second, the presence of water under freezing temperatures may also cause cracks in the wall when water expands as it freezes. Trapped water in the cavities in the CMUs may cause the CMUs to become discolored, and may even migrate into the dwelling.

To overcome the problems associated with water trapped within the CMU cavities, weep holes are commonly included along the base of the outer side of the CMUs in the lowermost course. The weep holes allow water to pass from the cavity to the drain outside the wall structure. A flashing disposed in the cavity directs the collected water toward the weep holes.

During construction of a single wythe masonry wall, excess mortar and other debris can and does fall into the cavities. When the CMUs are stacked during the erection of the wall, for example, mortar droppings are squeezed into cavities within the CMUs. The excess mortar, as well as other debris, drops to the base of the cavity, and can block weep holes.

One known solution is to construct a CMU drainage course consisting of two wythes separated by a cavity sized to accommodate through wall flashing and blocks of water permeable material. This solution uses different style concrete blocks in the drainage course.

Another known solution, shown in U.S. Pat. No. 6,202,366, uses a collection pan under each CMU cavity to collect water in the cavity. A weep channel on the pan drains the water to the exterior of the wall. This solution requires a collection pan for each vertical cavity.

The present invention is directed to solving one or more of the problems discussed above, in a novel and simple manner.

SUMMARY OF THE INVENTION

In accordance with the invention, there is provided drainage systems for use in concrete masonry unit (CMU) wall construction.

In accordance with one aspect of the invention, the drainage system comprises an elongate flashing member having a width similar to width of CMUs, to be received beneath a course of the CMUs, in use. A layer of water permeable material is attached to an upper surface of the flashing member. The layer of water permeable material includes a longitudinal portion extending longitudinally adjacent a rear edge of the flashing member and a plurality of longitudinally spaced transverse portions extending transversely from the longitudinal portion to a front edge of the flashing member. A plurality of blocks of water permeable material are provided, each being positioned above the layer of water permeable material and extending upwardly into cavities of the CMUs, in use. The water permeable material of the layer and the blocks have a porosity sufficient to permit water to pass therethrough but substantially insufficient to permit mortar and debris to pass therethrough so that water in cavities of the CMUs drains through the transverse portions.

It is a feature of the invention that the layers and the blocks are of the same type of water permeable material. The water permeable material may be a non-water absorbent randomly oriented fibrous material.

It is a feature of the invention that the blocks may be pyramidal or triangular.

It is another feature of the invention that the layer is in the range of ⅛ to ½ inch thick. Advantageously, the layer is about ¼ inch thick.

It is another feature of the invention that the transverse portions are spaced in the range of two to eight inches apart. The transverse portions may be about one inch across.

It is another feature of the invention to provide an elongate bar underneath the rear edge of the flashing member to channel water through the longitudinal portion to the transverse portions. A pair of transverse bars may also be provided underneath opposite longitudinal ends of the flashing member to channel water toward the front edge.

It is a further feature of the invention that the blocks comprise perforated tubes.

It is yet another feature of the invention that the blocks comprise rolls of fibrous mesh.

It is still another feature of the invention that the blocks are in contact with the layer of water permeable material.

There is disclosed in accordance with another aspect of the invention a drainage system for use in single wythe masonry wall construction formed by courses of CMUs each having vertical cavities. The drainage system comprises an elongate flashing member having a width similar to width of the CMUs, to be received beneath a course of CMUs, in use. An elongate bar is underneath a rear edge of the flashing member to define a dam at an interior side of the single wythe masonry wall. A layer of water permeable material is attached to an upper surface of the flashing member. The water permeable material includes an elongate longitudinal portion extending longitudinally outwardly of the dam and a plurality of transverse portions extending transversely from the longitudinal portion to a front edge of the flashing member. A plurality of blocks of water permeable material are each supported on the layer of water permeable material and extend upwardly into cavities of the CMUs, in use. The water permeable material of the layer and the blocks has a porosity sufficient to permit water to pass therethrough but substantially insufficient to permit mortar and debris to pass therethrough so that water in cavities of CMUs drains through the transverse portions.

There is disclosed in accordance with an alternative embodiment of the invention, a drainage system for use in single wythe masonry wall construction formed by courses of CMUs each having vertical cavities. The drainage system comprises an elongate flashing member that has a rear edge and a front edge. A layer of water permeable material is attached to an upper surface of the flashing member. The layer of water permeable material preferringly includes a plurality of longitudinally spaced apart transverse portions that extend toward the front edge of the flashing member. A plurality of vertical blocks of water permeable material are positioned above the layer of water permeable materials in contact with the transverse portions. The blocks extend upwardly into the cavities of the CMUs, in use.

It is a feature of the invention that the flashing member may have an outer edge portion that is inclined downwardly and outwardly from a substantially horizontal body portion thereof.

It is another feature of the invention that the flashing has an inner edge portion which is inclined upwardly and outwardly from the body portion thereof.

It is another feature of the invention that the layer of permeable material includes a longitudinal portion that is attached to an inner edge portion of the flashing member and the transverse are attached to a body portion of the flashing member.

It is another feature of the invention wherein the blocks are generally U-shaped and have a pair of spaced apart transversely extending leg portions and a longitudinally extending connecting portion that contacts the transverse portions, in use.

It is a further feature of the invention wherein the flashing member has a width that is less than the width of the CMUs.

Further features and advantages of the invention will be readily apparent from the specification and from the drawings.

DETAILED DESCRIPTION OF THE INVENTION

Figure 1:
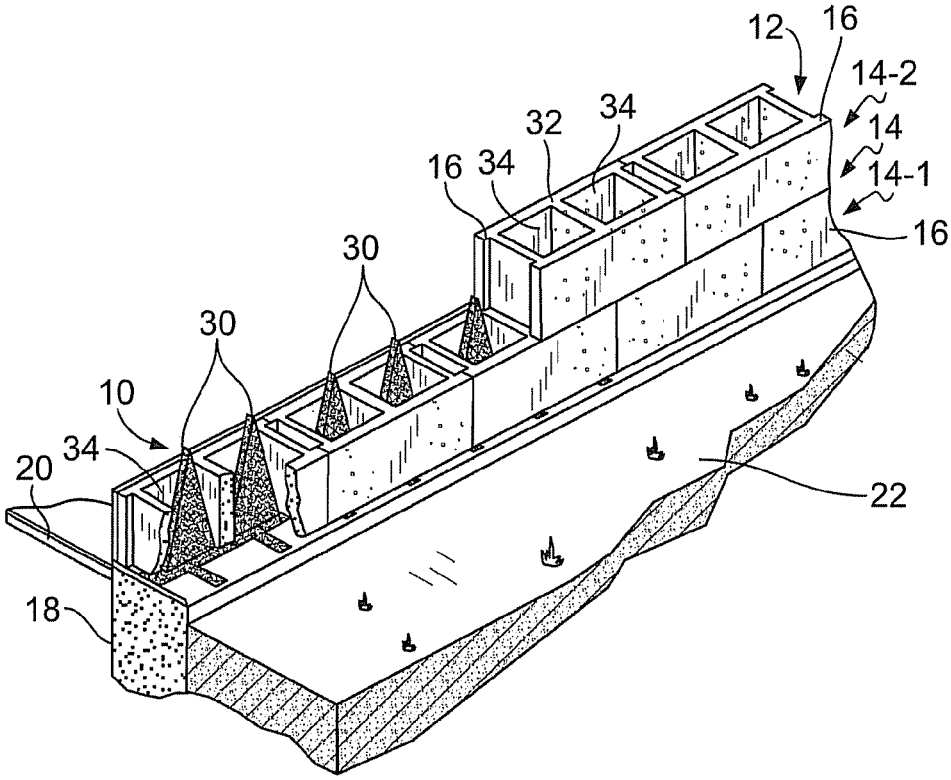
FIG. 1 is an exterior perspective view of a drainage system in accordance with a preferred embodiment of the invention used in a single wythe masonry wall formed by courses of concrete masonry units (CMUs)

Referring to FIG. 1, a preferred embodiment of a drainage system 10 is illustrated in connection with a concrete masonry unit (CMU) wall construction. In this illustrated embodiment of the invention, the drainage system 10 is used in a single wythe masonry wall construction 12 formed by courses 14 of CMUs 16. The wall construction 12 is used on a building structure including a foundation wall 18 with an interior floor 20 inside the foundation wall 18 and exterior grade 22 outside the foundation wall 18. In the illustrated embodiment of the invention, the foundation wall 18 comprises a concrete wall. The foundation wall could be of block construction, as will be apparent to those skilled in the art.

Figure 5:
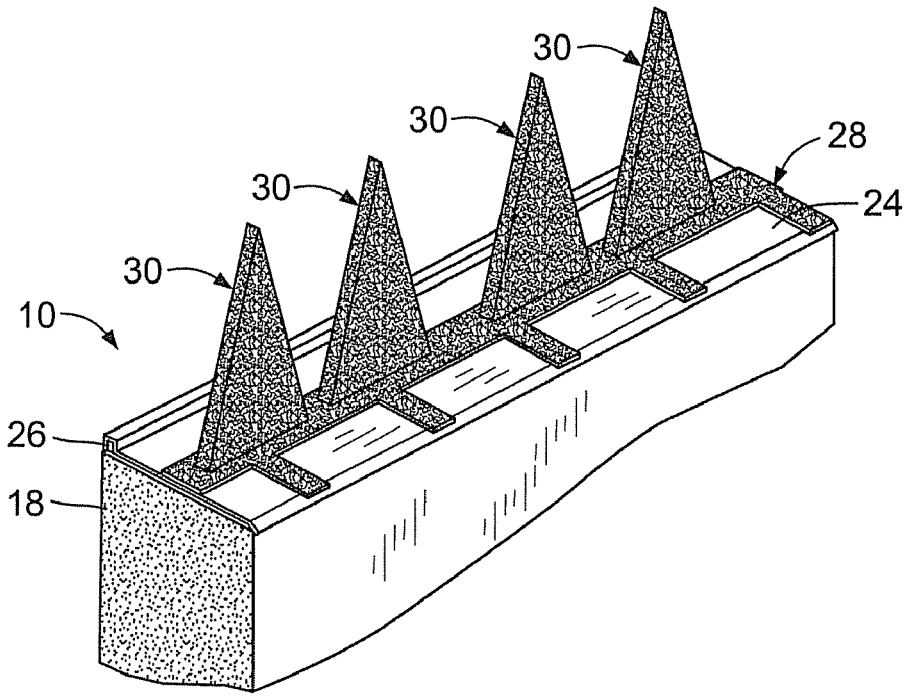
FIG. 5 is an exterior perspective view illustrating the drainage system in accordance with the invention mounted on a foundation.

Referring also to FIGS. 1 and 5, the drainage system 10 comprises a flashing member 24, an elongate bar 26, a layer 28 of water permeable material and a plurality of blocks 30 of water permeable material.

CMUs 16 are typically about eight inches wide and come in lengths of eight, ten and twelve inches. The CMU 16 comprises a concrete block 32 having a pair of vertically extending cavities 34 therethrough. In conventional single wythe masonry wall construction, a first course 14-1 of CMUs 16 is secured to the foundation wall 18 with a layer of mortar. Mortar is also provided between adjacent CMUs 16. A layer of mortar is then placed upon the first course 14-1 and the second course 14-2 is laid on the first course 14-1. Again, mortar is provided between each CMU 16. The CMUs 16 in each course are typically offset from one another as illustrated in FIG. 1. As a result, the vertical cavities 34 in any one course 14 are aligned with the vertical cavities 34 in other courses to provide a continuous channel from the top of the wall down to the foundation wall, as is well known.

Figure 2:
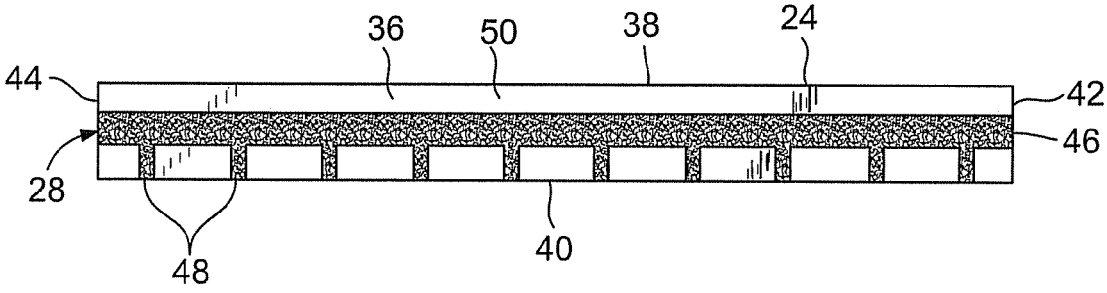
FIG. 2 is a plan view of a flashing member with a layer of water permeable material in accordance with the invention.

Referring to FIG. 2, the flashing member 24 comprises an elongate body 36 of flashing material. The body may be formed of plastic or sheet metal or the like. In the illustrated embodiment of the invention, the flashing member 24 comprises a peel and stick material. As such, an adhesive layer is provided on an underside of the body 36. The body 36 is defined by an inner or rear edge 38, an outer or front edge 40 and opposite longitudinal ends 42 and 44. Width of the body 36 is similar to width of the CMUs. The body 36 has a length sufficient to extend at least across a single cavity 34 or advantageously to extend the entire length of the foundation wall 18.

The layer 28 of water permeable material includes an elongate rectangular longitudinal portion 46 and a plurality of longitudinally spaced shorter, rectangular transverse channel portions 48 extending outwardly therefrom. As used herein, the relative term inner refers to the inner side of the foundation wall, i.e. the rear edge 38 of the flashing member 24, and outer refers to the outer side of the foundation wall, or the front edge 40 of the flashing member 24.

The layer 28 is adhered to a top surface 50 of the flashing member 24, such as by using a suitable adhesive. The longitudinal portion 46 is disposed outwardly adjacent the rear edge 38 at least one inch frontwardly of the rear edge 38. The transverse channel portions 48 extend transversely from the longitudinal portion 46 to the front edge 40 of the flashing member 24. The transverse channel portions 48 are approximately one inch across and are spaced apart in the range of two inches to eight inches, as necessary or desired. The layer 28 has a thickness in the range of about ⅛ inch to ½ inch with ¼ inch being typical. The longitudinal portion 46 serves to interconnect the transverse channel portions 48. In accordance with the invention, the layer 28 could be provided without the longitudinal portion 46 and use only individual transverse channel portions 48 extending to the front edge 40

In the illustrated embodiment of the invention, the water permeable material used in the layer 128 functions to permit water to pass therethrough and to substantially prevent mortar and other debris from passing therethrough. The material is preferably a non-absorbent water-permeable, fibrous mesh material formed with circuitous (non-linear) pathways. The material is preferably a massive random filament-type plastic fibers with a density which is sufficient to catch and support mortar and other debris thereon without significant collapse, but allow water to pass freely therethrough. A preferred embodiment of the material is a polyethylene or polyester fibrous mesh such as ENKADRAIN 7225, 7020 or 7010 normally manufactured by Coldbond Industries, or FIBERBOND EM 6645 manufactured by Fiberbond. The layer 128 may be provided as one piece or the transverse channel portions 148 may be provided separate from the longitudinal portion 146, as desired. The layer 128 may also be formed of a perforated tubular or cylindrical material. The mesh layer 128 may also provide drainage and/or wicking properties to remove water and moisture from the cavities.

Alternatively, the water permeable material could be made by a partial-fusion process which fuses closed-cell propylene or polyethylene beads together at the tangents of the beads. In this case water would flow between the beads in noncontacting areas.

Figure 3:
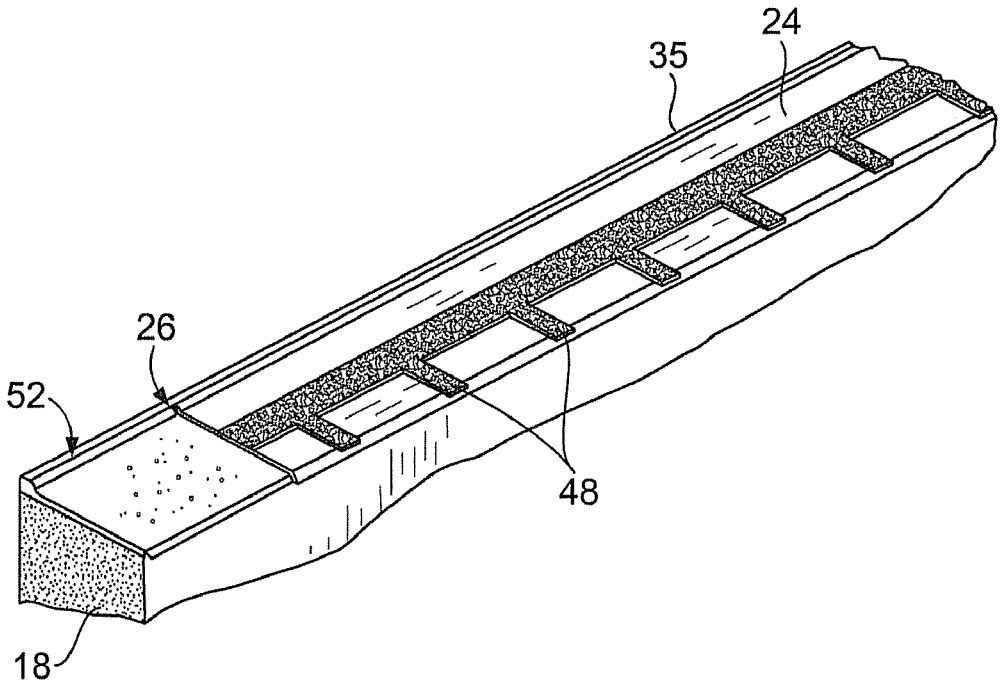
FIG. 3 is an exterior perspective view of an elongate bar and the flashing material of FIG. 2 mounted to a wall foundation.
Figure 4:
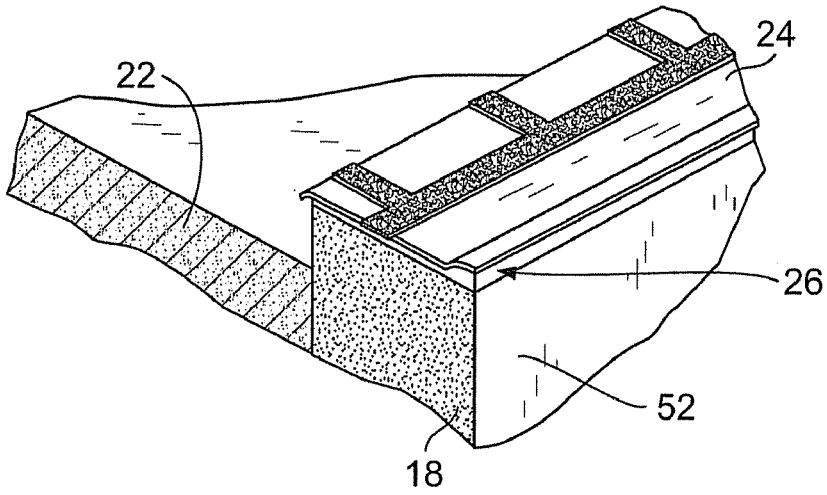
FIG. 4 is an interior perspective view of the elongate bar and the flashing material of FIG. 2 mounted to a wall foundation.

Referring also to FIG. 3, the elongate bar 26 consists of ¼ inch high bar stock of plastic placed along the foundation wall 18 near an interior side 52. The flashing member 24, a portion of which is shown in FIG. 3, is adhered to the foundation wall 18 with the rear edge 38 raised and overlying the elongate bar 26 to define a dam at the interior side 52 of a single wythe masonry wall. Due to the self adhering nature of the underside of the flashing member 24, the flashing member 24 adheres to the top of the foundation 18 and to the bar 26.

Thereafter, the first course 14-1 is constructed in the conventional manner applying mortar between the first course 14-1 and the flashing member 24. As such, the first course 14-1 is constructed on top of the flashing member 24 and layer 28. At least some of the transverse channel portions 48 are generally centered in the cavities 34 and serve to create weep holes within the mortar joint. If mesh material is used, the transverse channel portions 48 may be provided with suitable reinforcement such as solid plastic rods or the like to accommodate the load of the CMUs 16.

Figure 7:
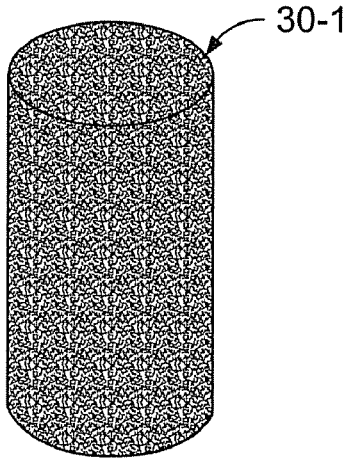
FIG. 7 is a perspective view of a block of water permeable material according to an alternative embodiment of the invention.
Figure 8:
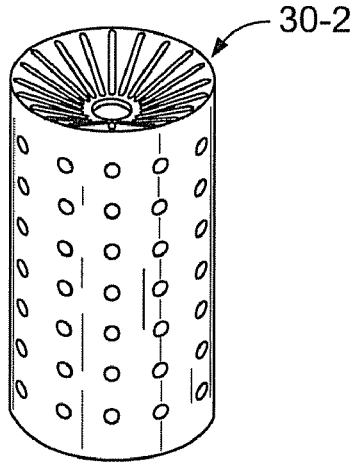
FIG. 8 is a perspective view of a block of water permeable material according to a further alternative embodiment of the invention.
Figure 9:
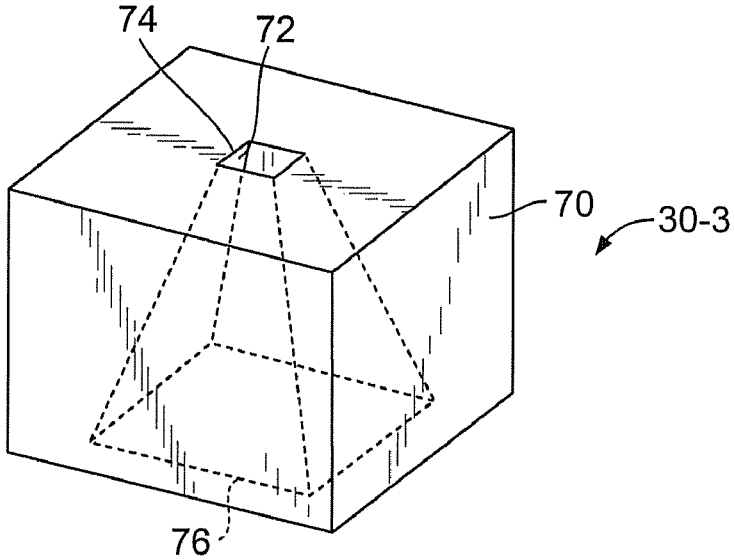
FIG. 9 is a perspective view of a block of water permeable material according to yet another alternative embodiment to the invention.

Referring to FIG. 5, the blocks 30 comprise wedge blocks and are preferably triangular or pyramid shaped and are of a water permeable material. The wedge blocks 30 could be of other shapes, such as conical or trapezoidal, or the like. The water permeable material may be the same material that is described above relative to the layer 28. In the illustrated embodiment of the invention, the blocks 30 are in the range of eight inches to sixteen inches tall and about two inches thick. The lower end has a width corresponding generally to the width of the CMU cavities 34. Subsequent to laying of the first course 14-1, the blocks 30 are placed in the cavities 34 and are positioned above the layer 28. This can be done by the blocks 30 being wedged in the cavities 34 or by the blocks 30 directly resting on the layer 28. Alternatively, the wedges 30 could be attached to the flashing member 24 or to the layer 28. As an alternative to the triangular wedge fiber mesh design, the blocks could consist of rolls 30-1, see FIG. 7, of fiber mesh material, as above. Also, the blocks could consist of perforated tubes 30-2, see FIG. 8, of plastic or the like. Other shape tubes could also be used.

In accordance with the invention, water in the CMU cavities 34 is channeled downwardly through the triangular wedges 30 and subsequently to the layer 28. Within the layer 28, the water is channeled to the transverse channel portions 48, either directly or through the longitudinal portion 46, where the water is channeled to the exterior of the foundation 18.

Figure 6:
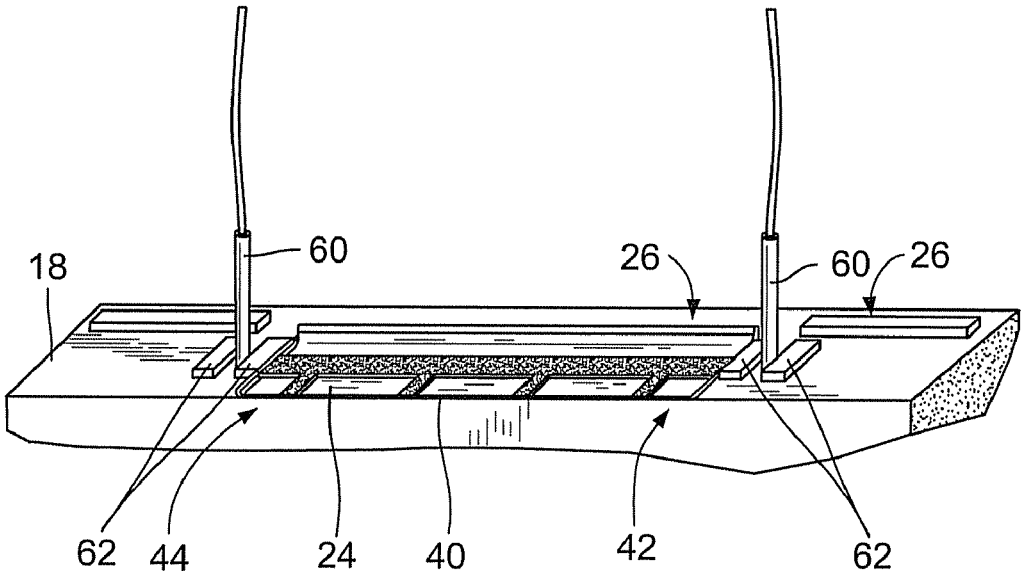
FIG. 6 is a perspective view of an alternative embodiment of the drainage system in accordance with the invention used in a reinforced single wythe masonry wall construction.

Referring to FIG. 6, rebar 60 may extend vertically from the foundation wall 18. For these applications ¼ inch plates 62 are positioned either side of each rebar 60 outwardly of the elongate bar 26. The flashing member 24 is cut to fit between the rebars 26 and the opposite ends 42 and 44 are raised up by the plates 62 to dam water that is then channeled out the front edge 40 of the flashing member 24 via the strips 48, as above.

Figure 16:
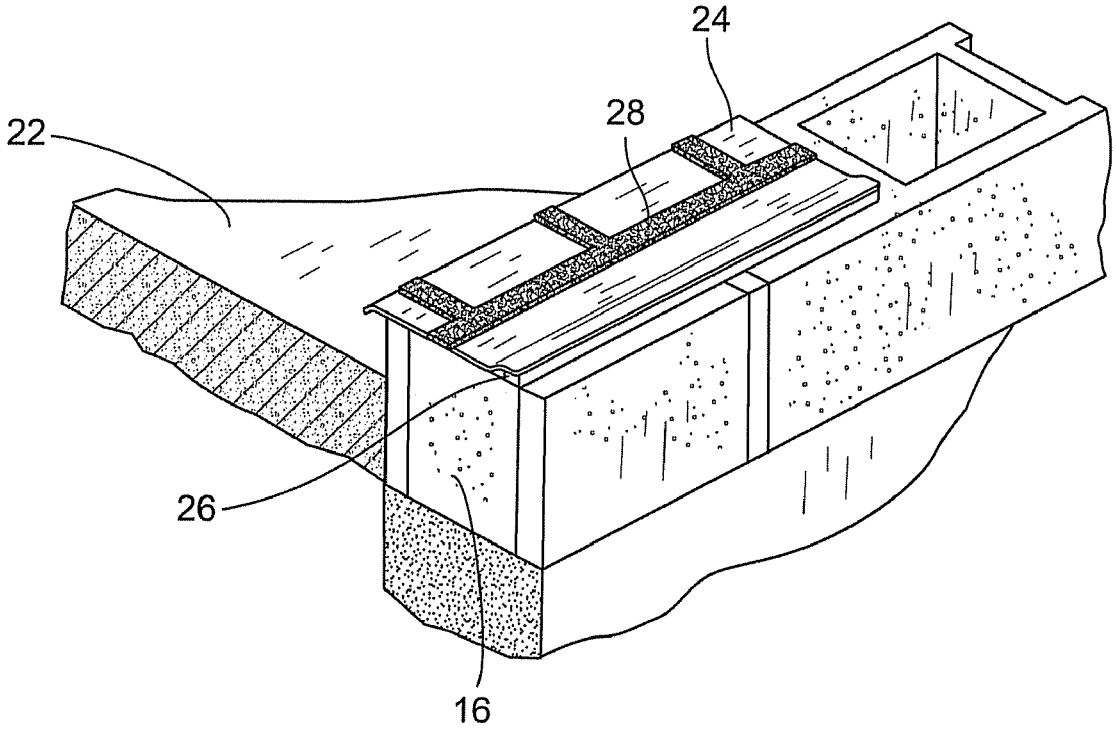
FIG. 16 is an interior perspective view similar to FIG. 4 showing a further alternative embodiment of the drainage system in accordance with the invention.

Referring to FIG. 16, there is shown an alternative embodiment of the invention wherein the flashing member 24 has a width that is less than the width of the CMUs 16 and the elongate bar 26 rests on the interior face of the CMUs.

Figure 17:
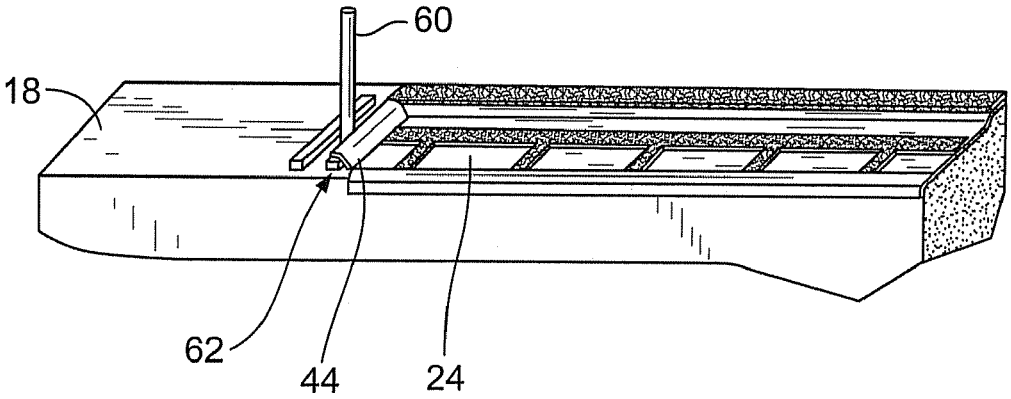
FIG. 17 is a perspective view similar to FIG. 6 showing a further alternative embodiment of the drainage system in accordance with the invention.

Referring to FIG. 17, there is shown an alternative embodiment of the invention wherein the opposite ends 42 and 44 overlap the top surface of the plates 62.

Referring to FIGS. 10-15, an alternative preferred embodiment of a drainage system 110 is illustrated in connection with a concrete masonry unit (CMU) wall construction 112. The masonry wall construction 112 is formed by courses 114 of CMUs 116. The wall construction 112 is used on a building structure including a foundation wall 118 with an interior floor 120 inside the foundation wall 118. The foundation wall 118 may be a concrete wall or could be of block construction, as will be apparent to those skilled in the art.

The drainage system 110 comprises an elongate flashing member 124, a layer of water permeable material 128 and a plurality of vertical blocks 130 of water permeable material.

The CMU 116 comprises a concrete block 132 having a pair of vertically extending cavities 134 therethrough. As discussed above, the vertical cavities 134 in any course 114 are aligned with the vertical cavities 134 in other courses to provide a continuous channel from the top of the wall down to the foundation.

Figure 14:
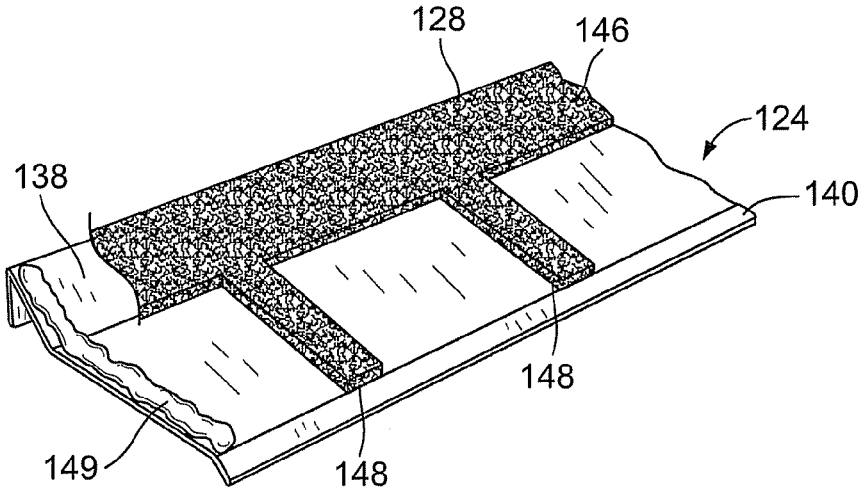
FIG. 14 is a perspective view of a preferred embodiment of a flashing member.

Referring to FIG. 14, the flashing member 124 is on an elongate member formed of sheet metal, plastic or the like. In accordance with a preferred embodiment, the flashing member 124 is formed with a body portion 136, an inner edge portion 138 and an outer edge portion 140 defining a drip edge. The flashing member has a width that is preferrably about half the width of the CMU. The body portion 136 is substantially horizontal in use, the outer edge portion 140 is inclined downwardly and outwardly from the body portion, and the inner edge 138 portion is incline upwardly and outwardly from the body portion.

The layer 128 of water permeable material includes an elongate longitudinal portion 146 that is attached to the inner edge portion 138 and a plurality of longitudinally spaced apart transverse portions 148 that are attached to the body portion 136 and extend from the longitudinal portion 146 toward the outer edge portion 140. The layer 128 is adhered to a top surface 150 of the flashing member 124, such as by using a suitable adhesive. The longitudinal portion 146 is attached to inner edge portion 138 and has a width approximately equal to the width of the inner edge portion. The transverse portions 148 are attached to the body portion 136 and extend from the longitudinal portion to the outer edge portion 140. The transverse portions preferrably extend a short distance onto the outer edge portion. The transverse portions are preferably spaced apart by a distance approximately equal to the width of the cavity of the CMU. The transverse portions 148 are approximately 0.5 to 1.5 inches across. The layer 128 has a thickness in the range of about ⅛ inch to ½ inch. The longitudinal portion 146 serves to interconnect the transverse portions 148. In accordance with the invention, the longitudinal portion 146 could be eliminated.

Alternatively, the water permeable material could be made by a partial-fusion process which fuses closed-cell propylene or polyethylene beads together at the tangents of the beads. In this case, water would flow between the beads in noncontacting areas.

Figure 15:
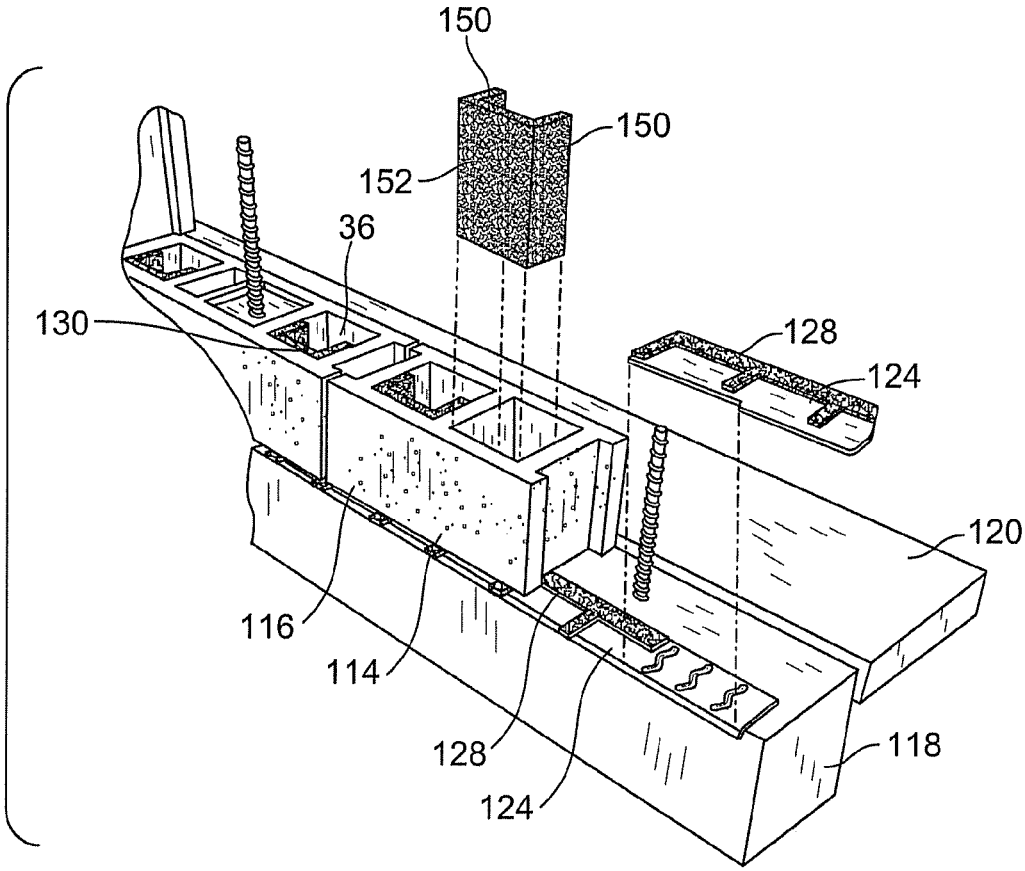
FIG. 15 is a perspective view of the drainage system of FIG. 10 showing installation of the flashing members and the vertical blocks.

Referring to FIG. 15, in accordance with a preferred aspect of the invention, the water permeable blocks 130 are general U-shaped in horizontal cross section. The blocks have a pair of spaced apart, transversely extending leg portions 150 and a longitudinally extending connecting portion 152 that extends therebetween. In use, the connecting portions is in contact with the transverse portions 148. The blocks 130 may be of other shapes, as discussed above. The block may be made of water permeable material as described above with respect to the layer 128.

Figure 10:
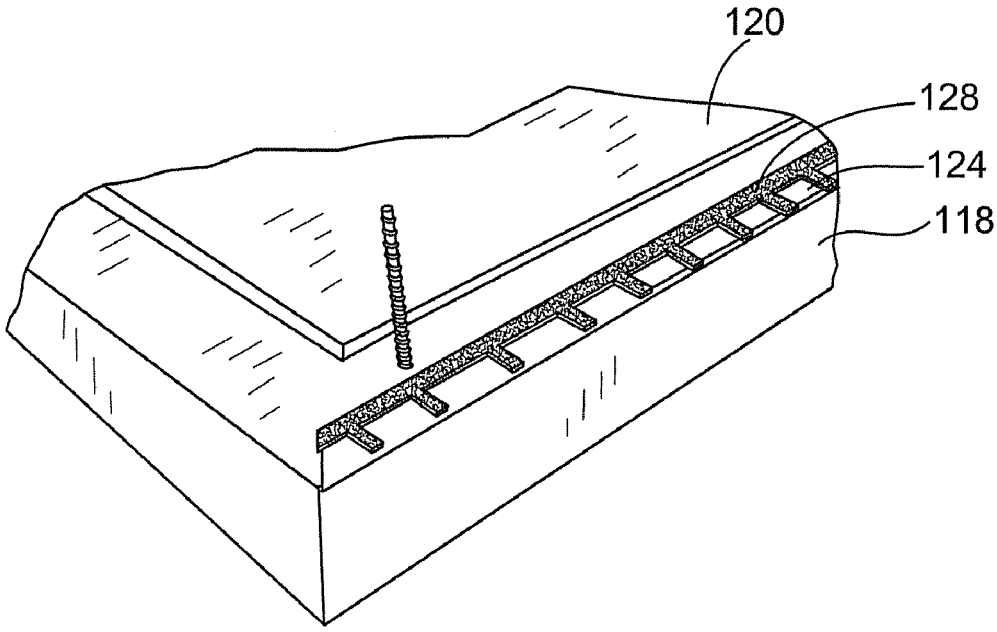
FIG. 10 is a perspective view of a drainage system in accordance with another preferred embodiment of the invention used in a single wythe masonry wall construction, showing a section of the drainage system installed on the foundation.
Figure 11:
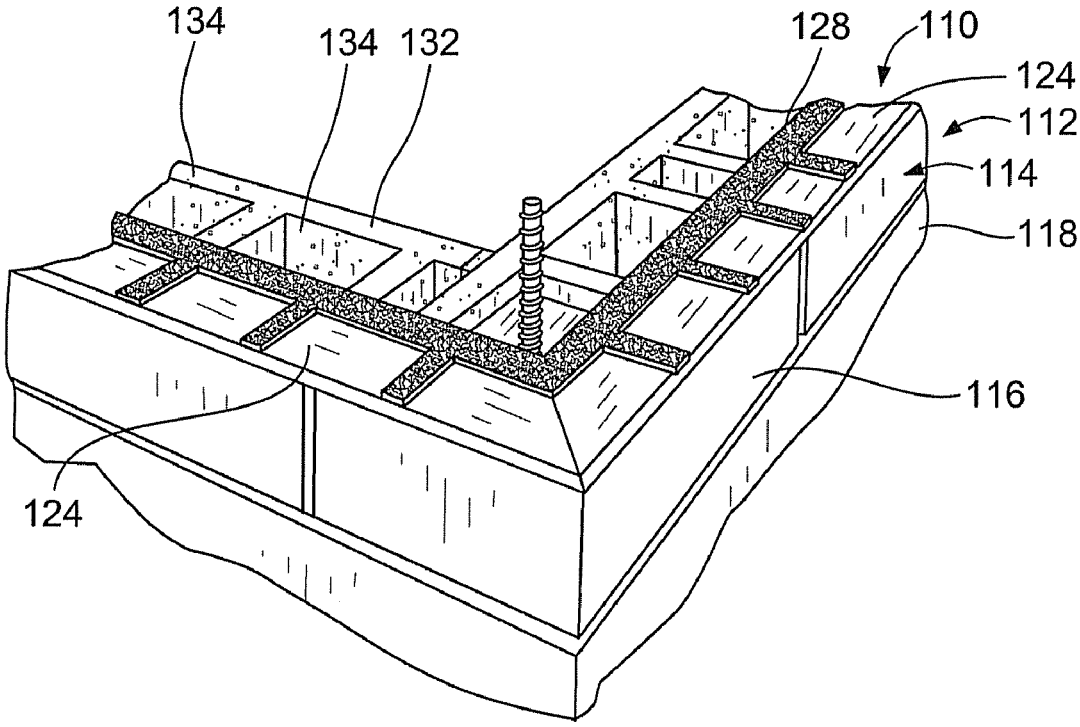
FIG. 11 is a perspective view of the drainage system of FIG. 10 showing flashing members of the drainage system installed on the first course of CMUs.

A brief discussion of the installation of the drainage system 100 is as follows. Referring to FIG. 10, a starter strip of the flashing member 124, with the mesh side up, is positioned on the foundation of the left corner of the wall or first course of block. The left end portion of the starter strip is mitered, as shown in FIG. 10. The flashing member 124 may rest on the foundation or the first course of block or may be stabilized by use of a compatible sealant or adhesive. The underside of the drip edge break is aligned with the front edge of the foundation or first course of block.

As seen in FIG. 15, the right end portions (about 6 inches in length) of the flashing members 124 are formed devoid of the layer 128 and the left end portions (about 6 inches in length) of the flashing member 124 are formed with the drip edge removed to permit the respective portions to overlap one another during installation. In installing the flashing members 124, three evenly spaced silicone sealant beads are applied to left end portion of one flashing member and the next flashing member is located so that the right end portion thereof rests upon the left end portion of the adjacent flashing member. This ensures an approximately 6 inch overlap of adjacent flashing members.

Figure 12:
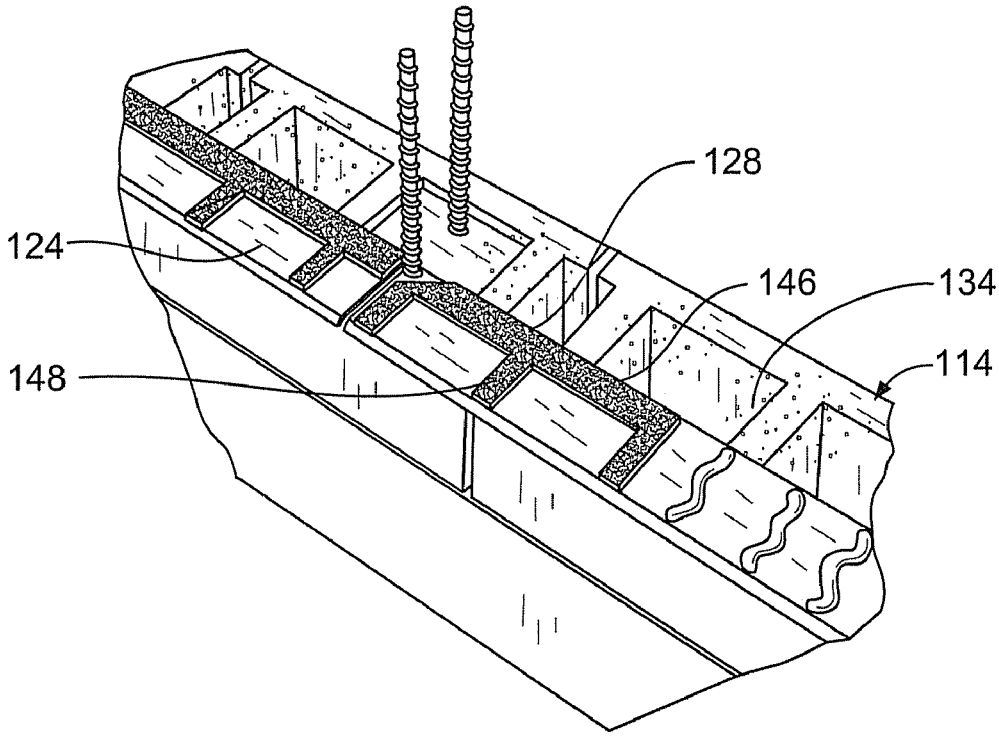
FIG. 12 is a perspective view of the drainage system of FIG. 11 showing installation of the flashing members around rebars.
Figure 13:
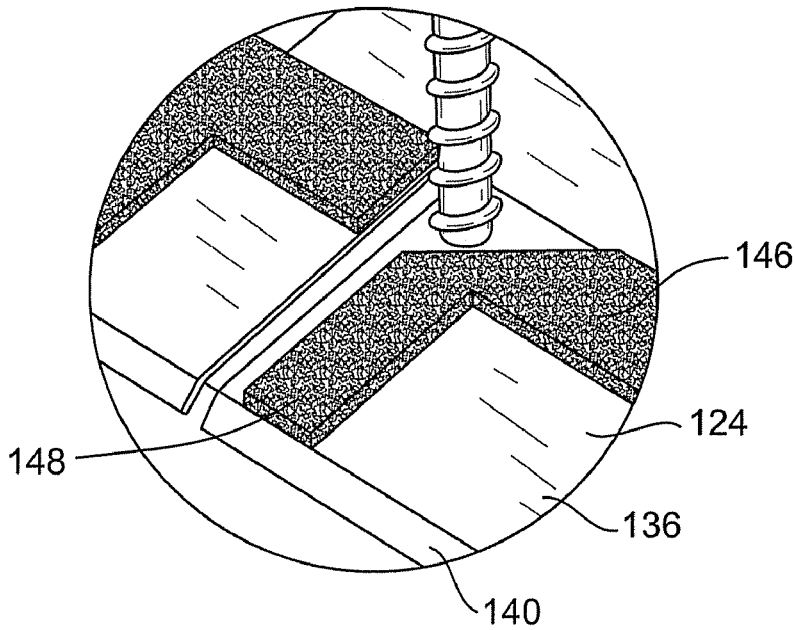
FIG. 13 is an enlarged perspective view of a portion of a flashing member adjacent a rebars.

As seen in FIG. 15, the width of the strips is such that the rebars do not interfere. Referring to FIGS. 12 and 13, if a rebar is positioned close to the front of the foundation, it is necessary to make a field cut to accommodate the rebar. In so doing, the flashing member is cut to length so that it abuts the rebar and a portion of the remainder of the flashing member is cut to accommodate the rebar. Any gaps may be sealed with a thin bead of sealant.

After the course of block directly above the flashing members 124 is set, the vertical blocks 130 are positioned in the cavities 134. The blocks 130 are installed against the outer face of the cavity. The blocks are preferrably dimensioned so that their width is slightly wider than a typical cavity, so that they have a "U" shape when viewed from above. Each block 130 comes in contact with a transverse portion 148 of the layer 128 in order to wick water therethrough.

Referring to FIG. 14, the mesh material 128 may be removed at one end of the flashing member 124 and the end dammed by a bead of caulking material 149 for use of the flushing member 124 over wall openings, bond beams and structured steel members.

Figure 18:
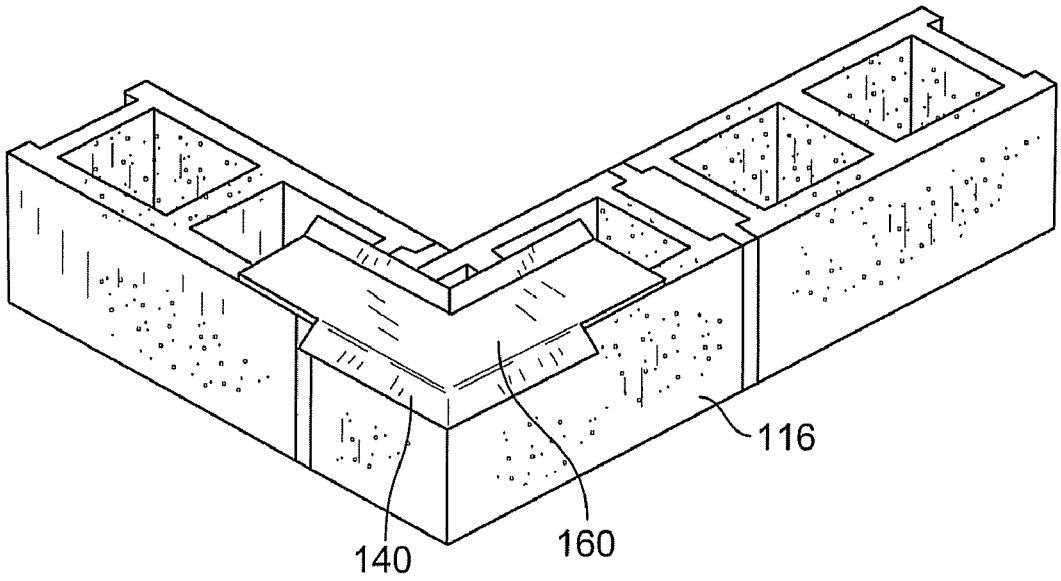
FIG. 18 is a perspective view similar to FIG. 11 showing a further alternative embodiment of the drainage system in accordance with the invention.

Referring to FIG. 18, there is shown an alternative embodiment of the invention wherein a right angled corner flashing member 160 is provided at the corner. Flashing member 160 preferrably does not have a layer 128. It should be noted that the outer drip edges 140 are removed from the outer portions of the flashing member 160 to facilitate receipt of an adjacent flashing members 124 that does not have the drip edge 140 removed from the overlapping end thereof.

Figure 19:
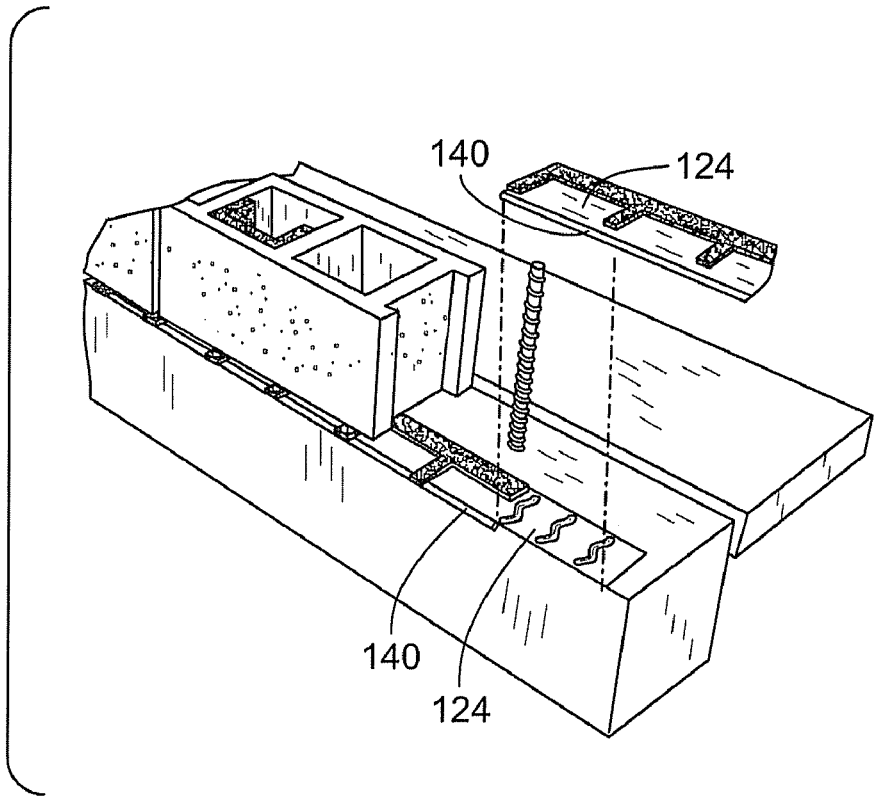
FIG. 19 is a perspective view similar to FIG. 15 showing a further alternative embodiment of the drainage system in accordance with the invention.

Referring to FIG. 19, there is shown an alternative embodiment of the invention wherein the drip edge is removed from the end of the flashing member 124 that is already installed and the cooperating end of the flashing member 124 to be installed has a drip edge that extends to the end thereof.

Thus, in accordance with the invention, there are provided single sheet-like products which serve as a flashing and a continuous drainage system that allows water to have an exit along substantially the entire length of the product. In so doing, the possibility of ponding is eliminated and ventilation of the cavities is increased. The installation of the combination flashing and mortar and debris collection devices and system of the present invention require no adhesives or attachments other than that normally associated with conventional flashing installations.

I claim:

1. A drainage system for use in concrete masonry unit (CMU) wall construction comprising:

a masonry wall including a plurality of CMUs, each CMU including at least one cavity having a cavity width and an inside face adjacent an outside face of the masonry wall and the inside face defining a part of the at least one cavity; and an elongate flashing member wherein the flashing member has a width sufficient to extend from the outside face and past the inside face of the CMU but less than the entire cavity width, said flashing having a rear edge and a front edge;

a layer of water permeable material attached to an upper surface of the flashing member, the layer of water permeable material including a plurality of longitudinally spaced apart transverse portions that extend toward the front edge of the flashing member; and a plurality of vertical blocks of water permeable material blocks positioned above the layer of water permeable material in contact with said transverse portions thereof, each of the blocks being positioned to extend upwardly into cavities of the CMUs, in use;

the water permeable material of the layer and the vertical blocks having a porosity sufficient to permit water to pass therethrough but substantially insufficient to permit mortar and debris to pass therethrough so that water in cavities of CMUs drains through the transverse portions.

2. The drainage system of claim 1, wherein the elongate flashing member comprises a body portion, an inner edge portion and an outer edge portion.

3. The drainage system of claim 2, wherein the body portion is substantially horizontal, in use.

4. The drainage system of claim 2, wherein the inner edge portion is inclined upwardly and outwardly from the body portion to channel water outwardly.

5. The drainage system of claim 3, wherein said transverse portions of said layer of permeable material are attached to the body portion of the flashing member.

6. The drainage system of claim 1, wherein the layer of water permeable material and the vertical blocks are of the same type of water permeable material.

7. The drainage system of claim 6, wherein the water permeable material is a non-water absorbent randomly oriented fibrous material.

8. The drainage system of claim 1 wherein the flashing member has an end portion that is devoid of a layer of water permeable material.

9. The drainage system of claim 1, wherein the layer of water permeable material is formed of draining materials.

* * * * *